US012089671B1

(12) United States Patent
Williams

(10) Patent No.: US 12,089,671 B1
(45) Date of Patent: Sep. 17, 2024

(54) GLOVE WITH SLITS FOR FINGERNAILS

(71) Applicant: Tameka V. Williams, Chicago, IL (US)

(72) Inventor: Tameka V. Williams, Chicago, IL (US)

( * ) Notice: Subject to any disclaimer, the term of this patent is extended or adjusted under 35 U.S.C. 154(b) by 61 days.

(21) Appl. No.: 17/748,688

(22) Filed: May 19, 2022

(51) Int. Cl.
*A41D 19/00* (2006.01)

(52) U.S. Cl.
CPC ..... *A41D 19/002* (2013.01)

(58) Field of Classification Search
CPC ..... A41D 19/0013; A41D 19/0024
See application file for complete search history.

(56) References Cited

U.S. PATENT DOCUMENTS

D106,139 S * 9/1937 Larom ..... 2/163
2,283,703 A * 5/1942 Stedman ..... A45D 29/004 132/285
2,335,320 A * 11/1943 Swietek ..... A41D 19/0013 132/73
2,513,030 A * 6/1950 Lazarian ..... A41D 19/0013 2/163
2,725,570 A * 12/1955 Penna ..... A41D 19/0013 2/163
4,345,335 A * 8/1982 Shih-Li ..... A63B 31/04 D29/117.1
4,577,648 A * 3/1986 Dinerstein ..... A45D 29/00 132/73
4,907,297 A * 3/1990 Gallucci ..... A41D 19/0013 2/163
5,070,543 A * 12/1991 Beck ..... A41D 19/0055 2/21
5,140,709 A * 8/1992 Cohn ..... A41D 19/0013 2/163
5,598,584 A * 2/1997 Da Grossa ..... A41D 19/0013 2/163
5,890,495 A * 4/1999 Cain ..... A41D 19/0013 132/73
6,026,513 A * 2/2000 Sima ..... A41D 19/0013 132/73
D729,455 S * 5/2015 Albera ..... D28/57
9,345,277 B2 * 5/2016 Albera ..... A41D 13/081
2010/0090966 A1 * 4/2010 Gregorio ..... A41D 19/0024 345/173
2012/0324620 A1 * 12/2012 Murphy ..... G06F 3/041 2/169

(Continued)

*Primary Examiner* — Jillian K Pierorazio
(74) *Attorney, Agent, or Firm* — Brie A. Crawford; Crawford Intellectual Property Law LLC

(57) ABSTRACT

A glove with slits for fingernails ("glove") has a base and a plurality of digit receiving sleeves ("sleeves") extending from the base. The slits are at the tips of the plurality of sleeves and a backing is attached to the interior surface of the plurality of sleeves to fully cover the slit. The interior surface of the sleeve and the backing form a pocket. Conductive threading is placed on the exterior surface of the glove. A method for using the glove has the user inserting their hand into an opening and then each of their digits into a sleeve. For the digits on which the user has longer fingernails, the digit is inserted into the pocket and the fingernail is inserted through the slit. For the digits on which the user has shorter fingernails, the digit and fingernail are inserted behind the backing.

16 Claims, 5 Drawing Sheets

(56) References Cited

U.S. PATENT DOCUMENTS

| | | | | |
|---|---|---|---|---|
| 2014/0033396 | A1* | 2/2014 | Hatfield | G06F 3/014 2/163 |
| 2016/0235140 | A1* | 8/2016 | Hoppe | A41D 19/01564 |
| 2021/0321699 | A1* | 10/2021 | Nelson | A63B 21/065 |

* cited by examiner

GLOVE WITH SLITS FOR FINGERNAILS

This invention relates to a glove with slits for fingernails and more particularly, this invention relates to a glove with slits for fingernails that has a slit to allow a fingernail to exit from the interior to the exterior of the glove and a pocket to protect the fingertips and conductive threading on the fingertips and knuckles of the glove. This invention also relates to a method for using the glove with slits for fingernails.

BACKGROUND OF THE INVENTION

Gloves are a very popular accessory both for functional reasons and aesthetic reasons. In colder climates, gloves are necessary to protect the thumbs and fingers (hereinafter "digits") and the hands of a user from environmental conditions. Gloves are also used as an accessory for fashion and to highlight or complete outfits. Gloves also may be used for sanitary purposes and to prevent the spread of germs, bacteria, viruses, or other microbes or pathogens. While gloves are very useful and, at times necessary, it can be difficult to wear gloves if a user has longer fingernails. It may be difficult to put the glove on over longer fingernails (and throughout the disclosure "fingernails" encompasses the nails on the fingers and the thumbs) and the fingernails may be so long that the user cannot wear a glove without damaging their fingernails and/or the glove. A glove that can be worn and accommodate for longer fingernails will be a useful invention.

A user may have longer fingernails on some digits, but shorter fingernails on other digits. This can create a problem where a glove needs to accommodate for longer fingernails on some digits, yet protect the tips of the digits for the digits with shorter fingernails and there can be longer and shorter fingernails on the same hand. A glove that can accommodate for digits with longer and shorter fingernails, and longer and shorter fingernails on the same hand, will be a useful invention.

Also, longer fingernails may damage the tips of gloves, even if the gloves can accommodate and receive digits with longer fingernails. Fingernails can be sharp or pointed and can rip or pierce the tips (or other portions) of the gloves. The user then has to mend or replace the gloves. This can be expensive, time-consuming, and possibly harmful to the environment. A glove that can accommodate for digits with longer fingernails and not be damaged or be less likely to be damaged will be a useful invention.

While wearing gloves, a user may need to use an electronic device with a touch screen, such as, but not limited to, a cell phone, smart watch, or tablet computer. It can be uncomfortable in colder places or environments or inconvenient in general to take off the gloves to use a touch screen electronic device. It can damage a touch screen electronic device to use fingernails to interact with the touch screen. A glove with slits for accommodating fingernails that can be worn while using a touch screen electronic device will be a useful invention.

SUMMARY OF THE INVENTION

An objective of the present invention is the provision of a glove with slits for fingernails that has slits to allow fingernails to exit from the interior to the exterior of the digit receiving sleeves on the glove.

A further objective of the present invention is the provision of a glove with slits for fingernails that can protect the tips of digits that do not have longer fingernails.

A still further objective of the present invention is the provision of a glove with slits for fingernails that can be worn with longer, sharp, or pointed fingernails and be less likely to be damaged by the fingernails.

Another objective of the present invention is the provision of a glove with slits for fingernails that has conductive threading to allow a user to interact with a touch screen electronic device while wearing the glove.

A method of using a glove with slits for fingernails is also disclosed.

Other objectives and advantages of the invention will become apparent from the description of the preferred embodiments herein.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
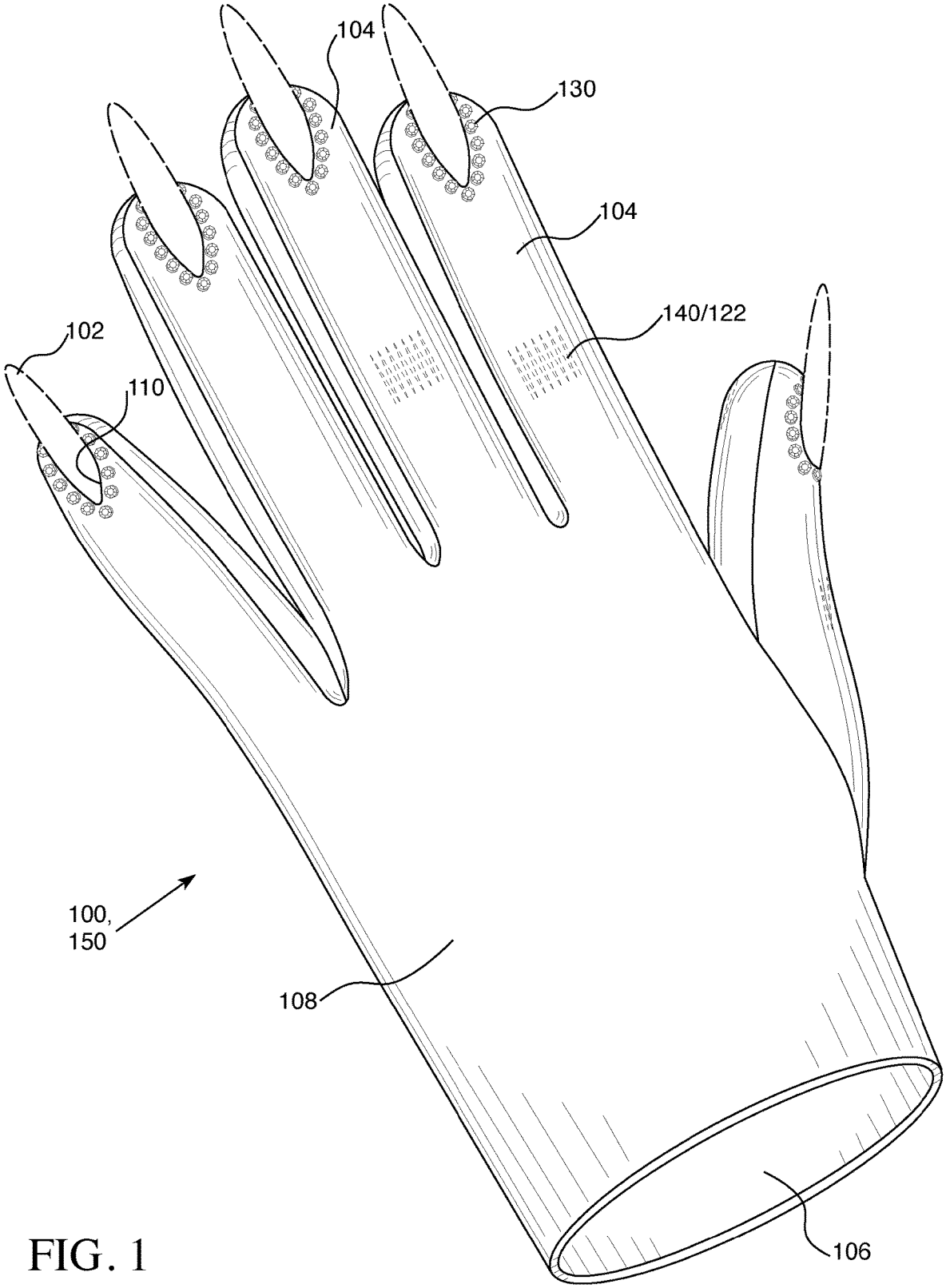
FIG. 1 depicts a front, perspective view of the glove with slits for fingernails 100 with the fingernails 102 depicted in phantom.
Figure 2:
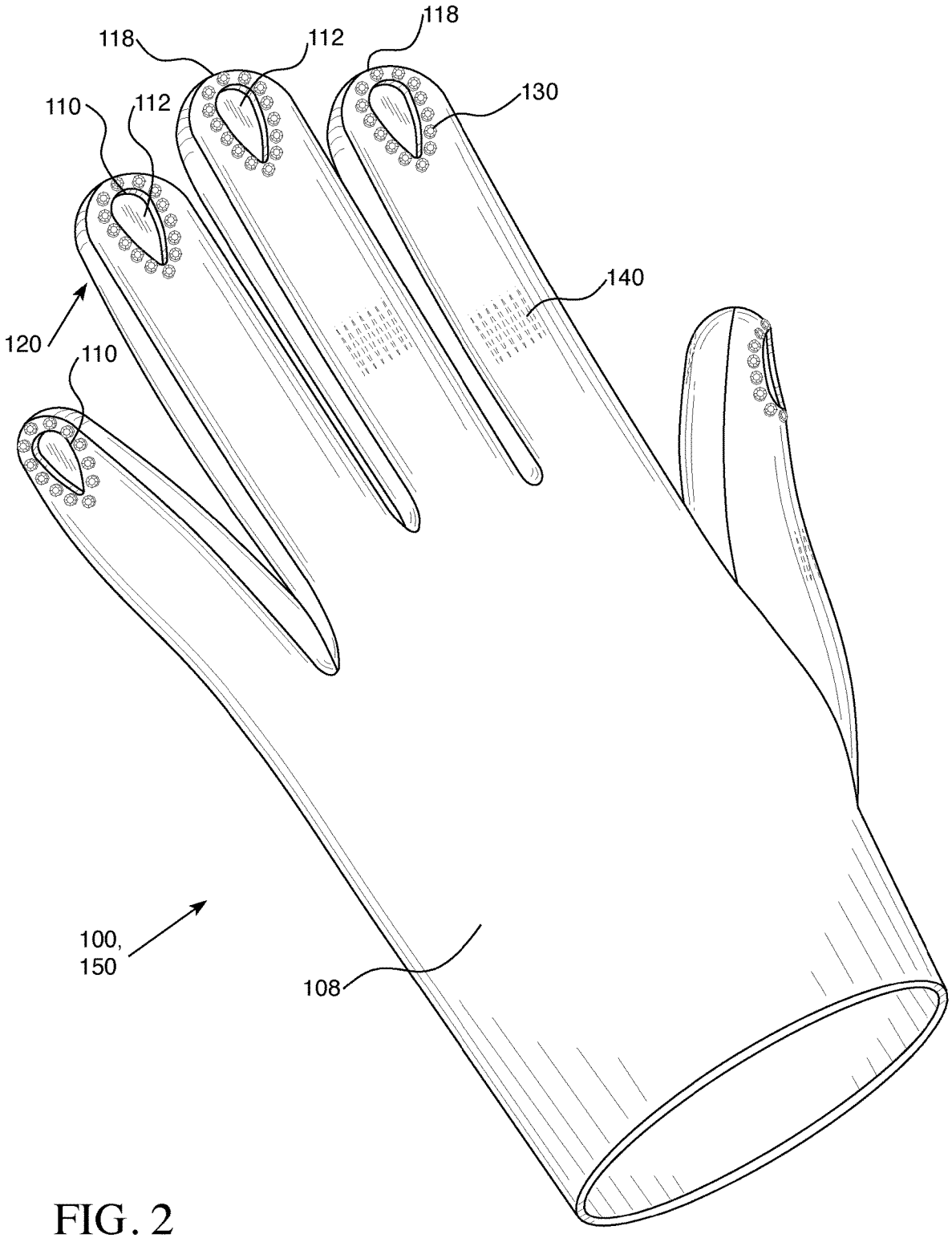
FIG. 2 depicts a front, perspective view of the glove with slits for fingernails 100.
Figure 3:
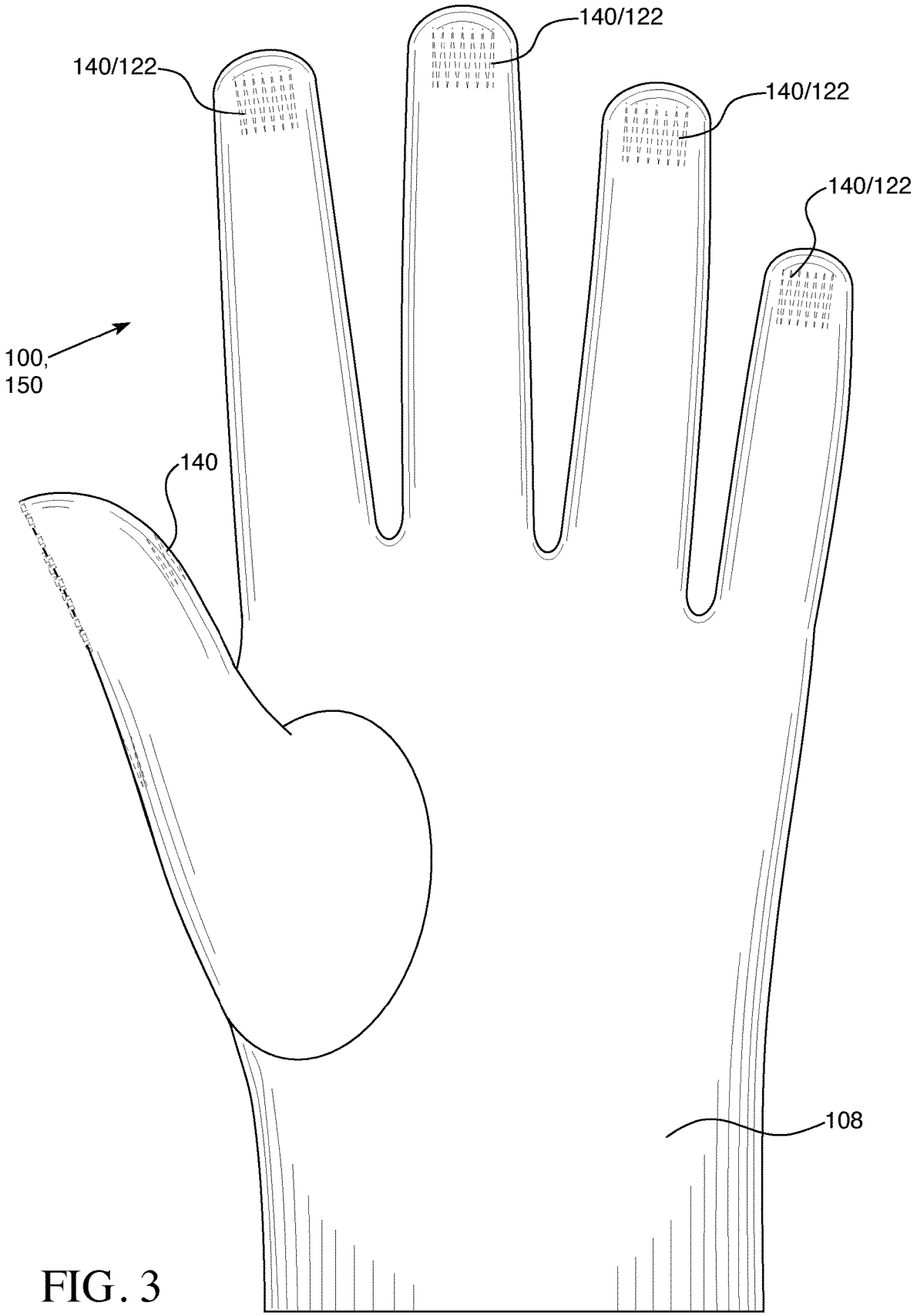
FIG. 3 depicts a rear view of the glove with slits for fingernails 100.
Figure 4:
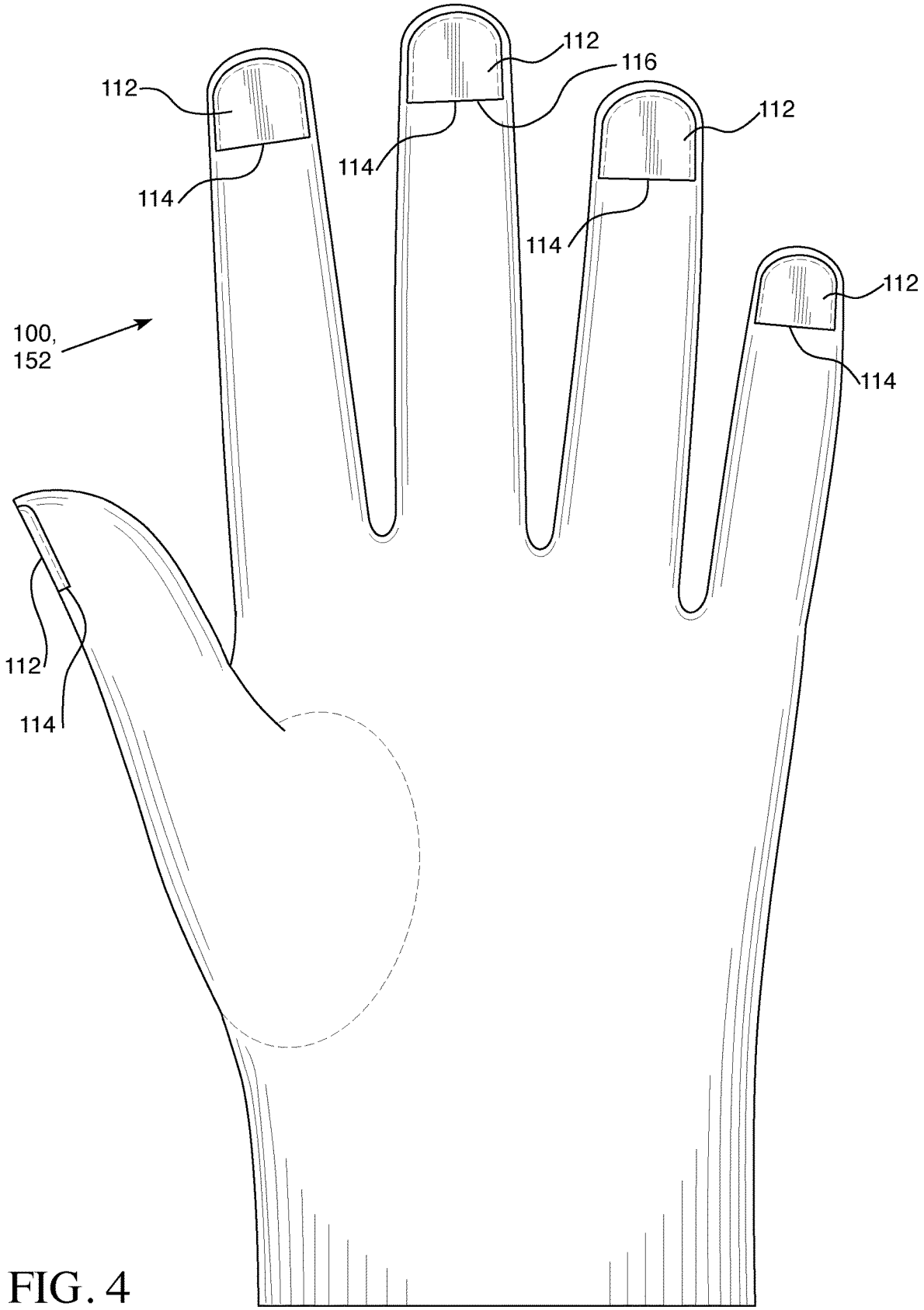
FIG. 4 depicts an inside-out view of the glove with slits for fingernails 100.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

For purposes of this disclosure, a long or longer fingernail 102 is defined as a fingernail 102 that extends past the end 118 of a digit receiving sleeve 104 when the glove with slits for fingernails 100 (hereinafter "glove or gloves 100") is placed on the hand of a user with the fingernails 102 passing through slits 110 to the exterior of glove 100. A short or shorter fingernail 102 is defined as a fingernail 102 that is even with or shorter than the end 118 of the digit receiving sleeve 104 when the glove 100 is placed on the hand of the user with the fingernails 102 passing through slits 110 to the exterior of glove 100.

Throughout the disclosure and in the drawings, there is one glove 100 depicted. The glove 100 encompasses a set or pair of gloves 100 and the second glove 100 is a mirror image of the depicted glove 100.

Now adding FIG. 1, FIG. 2, FIG. 3, and FIG. 4 to the consideration, the structure and function of glove 100 can be clearly seen. Glove 100 has a base 108 with an opening 106 and a plurality of digit receiving sleeves 104. Also, glove 100 has a plurality of slits 110 and a plurality of backings 112.

Slit 110 is on the tip 120 of each digit receiving sleeve 104 on glove 100. Backing 112 is attached to the interior surface 152 of each digit receiving sleeve 104 to cover the entirety of slit 110. The lower end 116 of backing 112 is not attached to the inside of digit receiving sleeve 104 so that it can form pocket 114 with slit 110 to receive fingernail 102.

The user can insert each of their digits into one of the plurality of digit receiving sleeves 104 and insert fingernail 102 into pocket 114, between the inside of digit receiving sleeve 104 and backing 112, so that fingernail 102 may extend through slit 110 and from the interior to the exterior of glove 100. If the user has a shorter fingernail 102, the user may place the entirety of their digit, including fingernail 102, behind backing 112 so that the digit and fingernail 102 are fully covered by the combination of glove 100 and backing 112.

It is preferred that glove 100 have conductive threading 140 on exterior surface 150 to allow a user to use a touch screen electronic device while wearing gloves 100. The conductive threading 140 is depicted on the exterior surface 150 of the knuckles and digit tips 122 in the drawings, but can be anywhere that is suitable, and all such locations are encompassed by this disclosure.

It is optional to embellish the exterior perimeter of slit 110, or other area of glove 100, with decorative material 130 such as, but not limited to, rhinestones or other rocks or jewels (either real or synthetic), sequins, glitter, threading, or any other decorative material and all suitable decorative materials are encompassed by this disclosure.

It is preferred that slit 110 is a vertical slit 110 so that when fingernail 102 is inserted into pocket 114 and through slit 110, vertical slit 110 naturally surrounds the fingernail 102 to provide protection to the portions of the digit surrounding the fingernail 102. It is preferred that vertical slits 110 run in a lengthwise direction in relation to the plurality of digit receiving sleeves.

In the drawings, only the fingernails 102 of the user are shown and the remainder of the user's hand is not shown.

Figure 5:
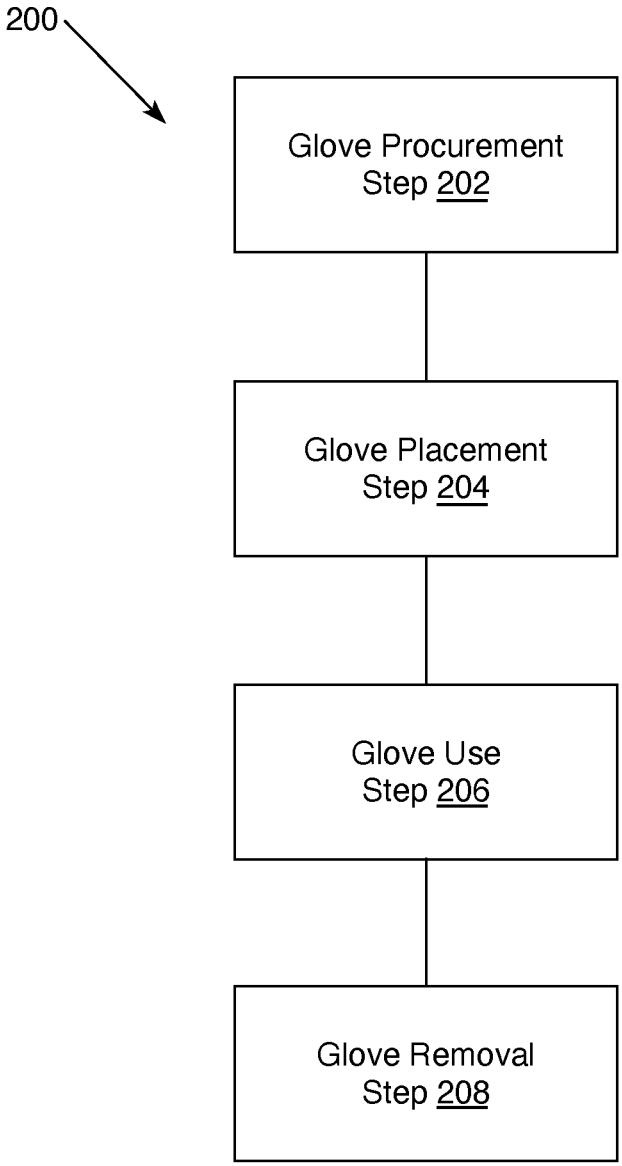
FIG. 5 depicts a block diagram of method 200 of this invention.

Now adding FIG. 5 to the consideration, method 200 can be clearly seen. Method 200 has the following steps. As will be obvious to persons of ordinary skill in the art, the steps, or steps equivalent thereto, may be practiced in any reasonable order which will produce the desired result.

STEP 202 is the glove procurement step. In this STEP 202, the user procures a set of gloves 100, if the user does not already have the set of gloves 100.

STEP 204 is the glove placement step. In this STEP 204, the user inserts their hand inside of opening 106 and then, the user places one digit in each of the digit receiving sleeves 104.

Inside each digit receiving sleeve 104, if the user has a longer fingernail 102, then the user inserts their digit in pocket 114 and their fingernail 102 through slit 110 so that the fingernail 102 is extending from slit 110 as in FIG. 1. Or, if the user has a shorter fingernail 102, the user inserts their digit, including fingernail 102, behind backing 112 as in FIG. 2.

The user may have all longer fingernails 102, all shorter fingernails 102, or a combination of longer and shorter fingernails 102. The combination of longer and shorter fingernails 102 can be on the same hand or different hands.

This process is repeated for both hands.

STEP 206 is the glove use step. In this STEP 206, the user conducts their daily activities with the gloves 100 on their hands. If the user needs to use a touch screen electronic device, the user can do so by using conductive threading 140 without the need to remove the glove or gloves 100.

STEP 208 is the glove removal step. In this STEP 208, the user removes the gloves 100 from their hands.

While various embodiments and aspects of the present invention have been described above, it should be understood that they have been presented by way of example only, and not limitation. Thus, the breadth and scope of the present invention should not be limited by any of the above exemplary embodiments.

This application—taken as a whole with the abstract, specification, claims, and drawings being combined—provides sufficient information for a person having ordinary skill in the art to practice the invention as disclosed herein. Any measures necessary to practice this invention are well within the skill of a person having ordinary skill in this art after that person has made a careful study of this disclosure.

Because of this disclosure and solely because of this disclosure, modification of this device and method can become clear to a person having ordinary skill in this particular art. Such modifications are clearly covered by this disclosure.

The invention claimed is:

1. A glove with slits for fingernails comprising:

a) the glove having an opening, a base, and a plurality of digit receiving sleeves, wherein the opening is configured to receive a plurality of digits and a hand of a user and each of the plurality of digit receiving sleeves is configured to receive a digit of the user;

b) each of the plurality of digit receiving sleeves having a slit, wherein the slit is configured to receive a fingernail of the user;

c) each of the plurality of digit receiving sleeves having a backing, wherein the backing cooperates with an interior of the digit receiving sleeve to form a pocket, further wherein the backing being attached to an interior surface of the digit receiving sleeve and a lower end of the backing not being attached to the interior surface of the digit receiving sleeve to create the pocket that does not slide across the interior surface of the digit receiving sleeve;

d) the pocket, in each digit receiving sleeve, being configured to receive the fingernail of the user between the backing and the slit to allow the user to extend the fingernail through the slit; and e) the backing being configured to allow the user to place their fingernail behind the backing, wherein the backing serves as a barrier between the fingernail and the slit to allow the user to cover the fingernail.

2. The glove with slits for fingernails of claim 1 further comprising:

a) the glove having conductive threading on an exterior surface.

3. The glove with slits for fingernails of claim 2 further comprising:

a) the plurality of slits being a plurality of vertical slits, wherein the plurality of slits run in a lengthwise direction in relation to the plurality of digit receiving sleeves.

4. The glove with slits of claim 3 further comprising:

a) the conductive threading being on a plurality of digit tips of the plurality of digit receiving sleeves on an opposite side of the plurality of slits and on a knuckle of an index and middle finger digit receiving sleeves on a same side as the plurality of slits.

5. The glove with slits of claim 4 further comprising:

a) a plurality of decorative materials surrounding a perimeter of each of the plurality of slits.

6. The glove with slits of claim 3 further comprising:

a) a plurality of decorative materials surrounding a perimeter of each of the plurality of slits.

7. The glove with slits for fingernails of claim 2 further comprising:

a) the conductive threading being on a plurality of digit tips of the plurality of digit receiving sleeves on an opposite side of the plurality of slits and on a knuckle of an index and middle finger digit receiving sleeves on a same side as the plurality of slits.

8. The glove with slits of claim 7 further comprising:

a) a plurality of decorative materials surrounding a perimeter of each of the plurality of slits.

9. The glove with slits of claim 2 further comprising:

a) a plurality of decorative materials surrounding a perimeter of each of the plurality of slits.

10. The glove with slits for fingernails of claim 1 further comprising:

a) the plurality of slits being a plurality of vertical slits, wherein the plurality of slits run in a lengthwise direction in relation to the plurality of digit receiving sleeves.

11. The glove with slits of claim 10 further comprising:

a) a conductive threading being on a plurality of digit tips of the plurality of digit receiving sleeves on an opposite side of the plurality of slits and on a knuckle of an index and middle finger digit receiving sleeves on a same side as the plurality of slits.

12. The glove with slits of claim 11 further comprising:

a) a plurality of decorative materials surrounding a perimeter of each of the plurality of slits.

13. The glove with slits of claim 10 further comprising:

a) a plurality of decorative materials surrounding a perimeter of each of the plurality of slits.

14. The glove with slits of claim 1 further comprising:

a) a plurality of decorative materials surrounding a perimeter of each of the plurality of slits.

15. A method of using a glove with slits for fingernails comprising:

a) obtaining a pair of gloves with slits for fingernails, wherein each of the gloves has a base with a plurality of digit receiving sleeves extending from the base, further wherein a slit is located at the exterior tip of each of the plurality of digit receiving sleeves and a backing is secured to the interior tip of each of the plurality of digit receiving sleeves, and further wherein the interior of each of the plurality of digit receiving sleeves and the backing form a pocket, and further wherein the backing being attached to an interior surface of the digit receiving sleeve and a lower end of the backing not being attached to the interior surface of the digit receiving sleeve to create the pocket that does not slide across the interior surface of the digit receiving sleeve;

b) a user inserting one hand into each of the gloves and one digit into each of the digit receiving sleeves, wherein the user inserts their digits with longer fingernails into the pocket and their fingernail being the back and the slit and through the slit, and further wherein the user inserts their digits with shorter fingernails behind the backing;

c) the user wearing the gloves; and d) the user removing the gloves.

16. The method of claim 15 further comprising:

a) the gloves having conductive threading on an exterior surface; and b) the user using a touch screen electronic device though the conductive threading and without removing the gloves.

* * * * *